US007059824B2

(12) United States Patent
Ramacciotti

(10) Patent No.: US 7,059,824 B2
(45) Date of Patent: Jun. 13, 2006

(54) SELF PRIMING CENTRIFUGAL PUMP

(75) Inventor: Romeo Ramacciotti, 10, Piazza Cittadella, 55100 Lucca (IT)

(73) Assignees: Romeo Ramacciotti, Lucca (IT); Renzo Biondi, Lucca (IT); Enrico Menegoni, Lucca (IT)

( * ) Notice: Subject to any disclaimer, the term of this patent is extended or adjusted under 35 U.S.C. 154(b) by 54 days.

(21) Appl. No.: 10/482,639

(22) PCT Filed: Jun. 25, 2002

(86) PCT No.: PCT/IT02/00419

§ 371 (c)(1),
(2), (4) Date: Dec. 26, 2003

(87) PCT Pub. No.: WO03/001065

PCT Pub. Date: Jan. 3, 2003

(65) Prior Publication Data

US 2004/0175279 A1 Sep. 9, 2004

(30) Foreign Application Priority Data

Jun. 26, 2001 (IT) ..... FI2001A0116

(51) Int. Cl.
*F04B 40/00* (2006.01)

(52) U.S. Cl. ..... 415/11; 415/56.4; 415/151

(58) Field of Classification Search ..... 415/11, 415/56.4, 56.5, 58.4, 151; 417/199.2
See application file for complete search history.

(56) References Cited

U.S. PATENT DOCUMENTS 1,824,465 A * 9/1931 Carter, Jr. ..... 415/11
2,100,365 A * 11/1937 Stratton ..... 415/11
2,174,960 A * 10/1939 Barzen ..... 415/11
2,391,769 A * 12/1945 Campbell ..... 417/199.2
2,639,671 A * 5/1953 Wagner ..... 415/11

* cited by examiner

*Primary Examiner*—Edward K. Look
*Assistant Examiner*—Igor Kershteyn
(74) *Attorney, Agent, or Firm*—Pollack, P.C.; Grant E. Pollack

(57) ABSTRACT

A centrifugal pump comprising a pump body (1) housing an impeller (3) keyed onto a motor shaft (4) and provided with a suction mouth (7) and a discharge mouth (8) capable of being made to communicate with, respectively, a suction pipe (9) and a discharge pipe (10). Between the suction mouth (7) and the suction pipe (9) there is provided a chamber (22) that communicates with a tank (11) situated at a level higher than the level of the pump, said tank being interposed between the discharge mouth (8) and the discharge pipe (10) and in communication with both of them and communicating also with the chamber (22) through a recirculation duct (28) having a section smaller than the section of the suction pipe (9). Between the tank (11) and the chamber (22) there is also provided means (13) for cutting off the flow that are controlled by the pressure existing in the tank to automatically cause the liquid to be recirculated in the tank to automatically cause the liquid to be recirculated through the chamber 822) and into the pump whenever the pressure in the tank drops below a predetermined value.

18 Claims, 1 Drawing Sheet

SELF PRIMING CENTRIFUGAL PUMP

FIELD OF THE INVENTION

The present invention relates generally to a positive displacement apparatus for effecting fluid motion and, more particularly, to devices for automating operation of pumps or the like.

BACKGROUND OF THE INVENTION

Conventional centrifugal pumps typically comprise an impeller mounted to a motor shaft, a liquid to be pumped entering the impeller along its axis of rotation. The impeller is provided with blades that force the liquid radially toward the impeller circumference, thereby discharging the liquid at a relatively high speed into a volute formed within a casing surrounding the impeller. The centrifugal force generated by rotation of the impeller accelerates the liquid to a high speed. In turn, the dynamic pressure associated therewith is converted to static pressure in the volute, where the speed is gradually reduced. A significant limitation associated with centrifugal pumps, as well as other pumps that do not provide volumetric displacement of liquid, is that, at start-up when the pump is empty, such pumps are unable to remove a significant quantity of air from the suction pipe. Hence, auxiliary devices must be provided that allow the pumps to be primed, after which time they will function normally.

When a centrifugal pump is installed at a level higher than that of the tank from which the liquid is to be taken, one way to provide self-priming has been to maintain a sufficient quantity of liquid at the impeller entry during the self-priming phase or, alternatively, to pass it through an appropriate opening in the volute casing. This approach, however, usually requires that a tank be provided to contain liquid for the priming process. It is also characterized by a relatively low self-priming height and an unavoidable pressure drop, since the openings needed for the priming process also remain active during pump operation. This type of priming has been used primarily for agricultural applications.

Another way to insure self-priming of a centrifugal pump has been to use an auxiliary vacuum pump. While such an arrangement has generally been found efficient, it has also has been costly.

A further approach has been to incorporate an ejector between the suction mouth and the impeller entry. In pumps of this type, or so-called "jet pumps", the pump body is filled with liquid during pump start-up so as to also fill the ejector. After the pump has been started-up, the impeller induces circulation of liquid through the ejector that entrains gas, thus forming a liquid-gas mixture of from which the gas will separate in the upper portion of the pump body. Recirculation of the liquid-gas mixture continues until the gas has been eliminated. Thereafter, the pump will function in a normal manner.

Although jet pumps are considered easy to use and have been found less costly to install than other systems, their performance has been greatly impeded both by the section restriction of the ejector installed in the suction conduit and by the pressure drop that results from an orifice situated in front of the Venturi tube, which remains active even when the pump is in operation. While pumps having no self-priming devices are generally more efficient than jet pumps, their operation is often hindered by the possible presence of air bubbles or pockets in the suction pipe. In situations where it is essential for the pump to operate with reasonable continuity, these pumps require accessories, auxiliary systems or the continuous presence of supervisory personnel.

There are also applications where it is important that the pump be mobile (e.g., motor pumps for agriculture, fire-fighting services, road tankers, and emergencies of various kinds) and, hence, require a self-priming system that is not only fast and reliable, but also highly efficient.

OBJECTS AND SUMMARY OF THE INVENTION

Accordingly, it is an object of the present invention to provide a centrifugal pump capable of automatically priming its fluid flow without the disadvantages of conven-tional centrifugal pumps.

It is also an object of the present invention to provide a self-priming centrifugal pump in which the basic pump characteristics, namely, discharge, head and efficiency, remain unchanged.

Another object of the present invention is to provide a self-priming centrifugal pump that is devoid of section restrictions on the suction side and, thereby, operates with an efficiency greater than that of conventional jet pumps.

A further object of the present invention is to provide a centrifugal pump that does not require accessories or auxiliary systems for priming, at a lower cost than conventional centrifugal pumps with assisted start-up needs.

Yet another object of the present invention is to provide a self-priming pump that is not susceptable to momentary or permanent shut-down that can result when some deviation occurs from normal operating conditions and, upon such deviation, automatically reestablishes, normal operating conditions without intervention of supervisory personnel.

Yet another object of the present invention is to provide a device for converting a non-self-priming pump into a self-priming pump and for making the device available as an accessory that can easily be integrated into such a pump.

BRIEF DESCRIPTION OF THE DRAWINGS

These and other objects and advantages of the self-priming centrifugal pump, in accordance with the present invention, will become apparent from the description of specific, illustrative embodiments thereof, set forth below with reference to the following drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
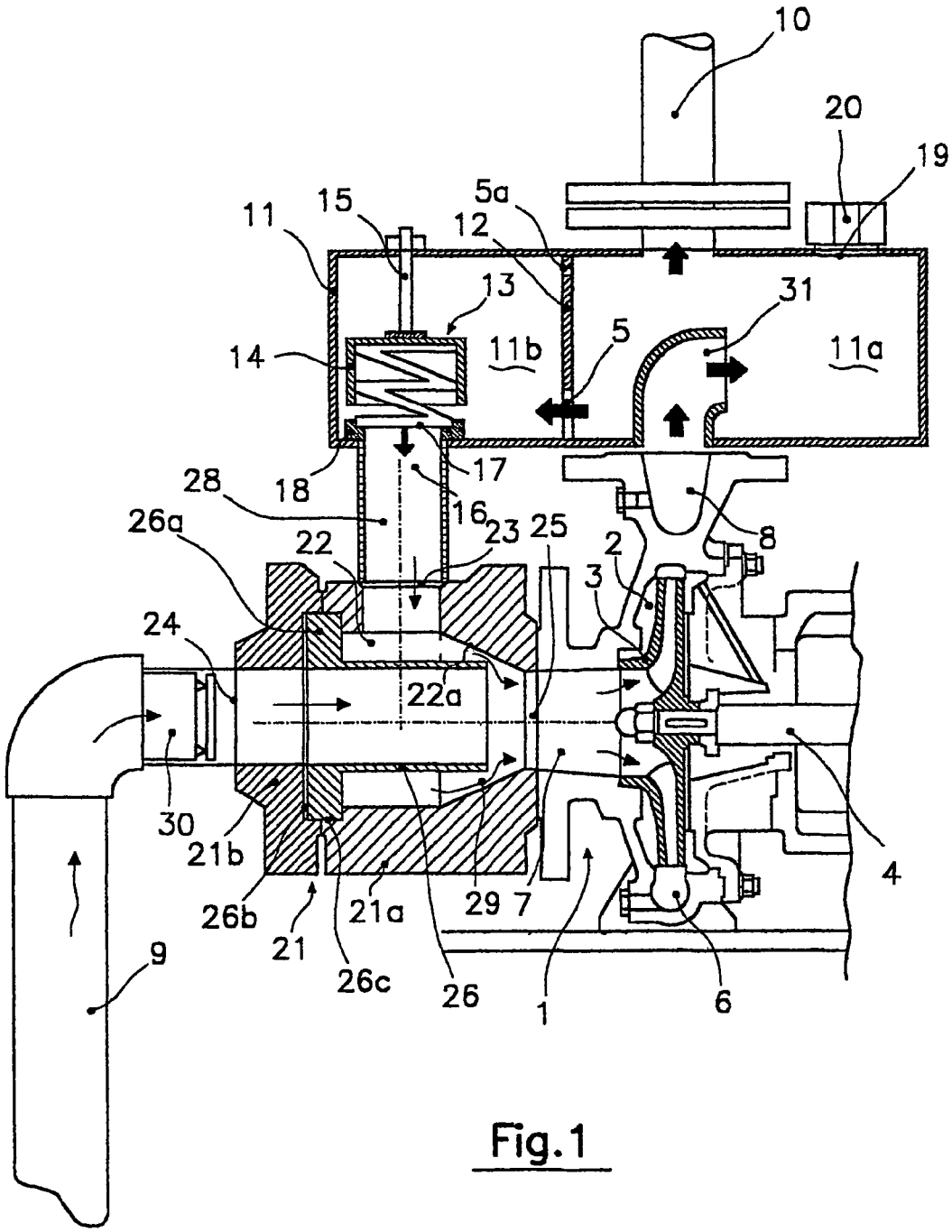
FIG. 1 is a sectional view of a self-priming centrifugal pump, in accordance with one embodiment of the present invention.

Referring now to the drawings and, more particularly, to FIG. 1, there is shown generally a specific, illustrative self-priming centrifugal pump, according to various aspects of the present invention. According to one embodiment, shown generally FIG. 1, a pump body 1 having a substantially conventional shape that defines a chamber 2 housing an impeller 3 keyed onto a shaft 4. The shaft is rotated by a motor not shown on the drawing. The periphery of impeller 3 faces a volute 6 of a conventional type that is formed correspondingly on an interior face of the pump body that delimits chamber 2. Between impeller 3 and pump body 1 there is provided, in a known manner, a sealing device (also not shown in the drawings. The pump body also comprises a suction mouth 7, coaxial with shaft 4 and an intake of impeller 3, and a discharge mouth 8, arranged with its axis at right angles to shaft 4 and in an eccentric position with respect to the shaft. Further, reference numbers 9 and 10 generally denote, respectively, a suction pipe upstream of the pump and a discharge pipe downstream thereof.

Interposed between discharge mouth 8 and discharge pipe 10 is a tank 11, subdivided internally into two chambers 11*a* and 11*b* by a vertical wall 12, the wall having with a relatively large passage hole 5 at its bottom end and a relatively small air circulation hole 5*a* near its top, the latter to avoid air pocket formation during the filling process. More particularly, the two chambers include a first chamber 11*a*, which is connected to the discharge pipe and accommodates the discharge mouth 8 of the pump, and a second chamber 11*b* that communicates, in a manner described below, with the suction side of the pump through a cut-off valve 13. In addition, cut-off valve 13 comprises a cap 14 integral with a rod 15 connected slidably to tank 11, the cap receiving an appropriately calibrated helicoidal compression spring 17. The position of cap 14, which acts essentially as a shutter relative to a passage 16 provided on the tank bottom, is controlled by the pressure exerted by the liquid in tank 11, such pressure being in opposition to a biasing force of spring 17 located between cap 14 and a seating ring 18 that surrounds passage 16 and is mounted to the tank bottom. Tank 11 is also provided with a filling mouth 19 that may be closed using a three-way tap 20 or the like which operates as a stopper for the intake and air-vent.

Between pump suction mouth 7 and suction pipe 9, there is provided a body 21 comprising two elements 21*a* and 21*b* combined in such a manner as to delimit an inner chamber 22. The body also has first and second inlet ports 23 and 24 formed, respectively, on elements 21*a* and 21*b*, as well as an outlet port 25 formed on element 21*a* and coaxial to second intake port 24. Preferably, the outlet port is attached to the flange of pump suction mouth 7 and has the same diameter generally as the mouth. First inlet port 23 is desirably positioned so as to be in communication with first chamber 11*b* of tank 11 by way of a recirculation pipe 28.

It is preferred that a pipe stub 26 additionally be provided having the same internal diameter as suction mouth 7 and arranged coaxially with intake port 24 inside chamber 22. Pipe stub 26 further includes a collar 26*a* which enables it to be mounted in a selected position of alignment axially with intake port 24 and outlet port 25, and between elements 21*a* and 21*b*. A seating is preferably provided on each of the faces by which these elements are joined to one another so as to accommodate collar 26*a* and annular adjustment shims 26*b*.

Desirably, chamber 22 within body 21 has a portion 22*a* formed in the shape of a truncated cone that converges at outlet port 25, pipe stub 26 extending up into proximity of this portion, thus defining an annular passage 29. The flow cross-section of this annular passage is regulatable to an optimum value for a desired suction head by moving one or more annular shims 26*b* from between collar 26*a* and element 21*b* of body 1, to between collar 26*a* and element 21*a* of body 21, and vice versa.

Recirculation pipe 28 must necessarily have a cross-section substantially smaller than that of the suction pipe, preferably about half its size, an optimum size in both length and section accounting for characteristics of the pump, the desired suction head, and be matched to annular passage 29 in order to achieve adequate pressure drop. Likewise, annular passage 29 has a flow cross-section smaller than that of the recirculation pipe 28. Preferably, a backflow-prevention device 30, such as a non-return valve, is provided, in addition, between suction pipe 9 and body 21.

The configuration of the pump, in accordance with the embodiment of the present invention as described above, is preferably such that when annular passage 29 is adjusted to its mini-mum flow cross-section, the quantity of liquid that reaches the impeller inlet for the entire duration of the self-priming process is generally smaller than the quantity drawn in by the pump, when operating at maximum capacity. This insures that the impeller is not saturated, so that it will have the suction reserve needed to create a vacuum in the suction pipe and achieve self-priming at a maximum height (about 9 m in 2'30").

When the annular passage is adjusted to intermediate levels by removing one or more of annular shims 26*b*, the resulting quantity of liquid arriving at the impeller inlet during self-priming is greater than in the previous case and may cause the impeller to become saturated at intermediate manometric suction values. This arrangement or mode is recommended for decreasing the time necessary for self-priming when the liquid to be drawn in is at a relatively low level (4–7 m on 1'40").

When the pump operates without pipe stub 26, a maximum quantity of liquid can be made to reach the impeller inlet during the self-priming process, such that the impeller will become saturated in the presence of intermediate manometric suction values. This mode of operation is recommended for reducing the amount of time needed for self-priming when the liquid to be pumped is at a relatively low height below the pump (up to about 4 m in 40").

As these operating modes demonstrate, the air present in the suction pipe is extracted directly by the impeller and not simply by being entrained along with the liquid as often occurs when jet pumps are used.

Before the pump is started, the entire group (i.e., tank 11, interior pump spaces, chamber 22, sleeve 26 up to valve 30 and recirculation pipe 28) is flooded by filling the tank with liquid through inlet opening 19. Once the pump mechanism has been set in motion, the centrifugal action of impeller 3 forces the liquid contained in tank 11 through volute 6.

Consequently and at the same time, a vacuum of substantially high manometric value is generated at the impeller inlet This, in turn, causes non-return valve 30 to open, so that air is drawn in from suction pipe 9. The air, together with the water arriving from tank 11 through pipe 28 and annular passage 29, is then drawn into the impeller, thereby starting the self-priming process. The high manometric value insures the intake of a substantial quantity of air-liquid mixture, whereas air with relatively low inertia arrives readily at the impeller. As for liquid traveling from the tank, given its relatively greater inertia and the predetermined pressure drop that results from its passage through pipe 28 and annular passage 29, encounters more difficulty and arrives in generally smaller quantity. The mixture taken in by the impeller will, in turn, becomes richer in air, causing a gradual reduction of its suction power, such that the non-return valve will eventually close and prevent any further outflow of air. With only water from tank 11 reaching the impeller through pipe 28 and passage 29, the suction power of the impeller is increased again, so that the non-return valve will open once more. When the resulting air flow becomes excessive, the valve will again limit the suction power of the impeller, thus causing the non-return valve to close, so that the impeller will once again be filled with liquid only. The accompanying increase in the impeller's suction capacity then draws more air from the suction pipe through the non-return valve. When the air removal rate from the suction pipe is optimal, the self-priming process will proceed in a regular and continuous manner until some unbalance occurs due to an excess of air (given that an excess of water may likely bring the self-priming process to a halt) with respect to initial calibration of the system using an appropriate number of annular shims 26*b*.

The air present in the stream discharged into tank 11 then separates from the liquid and escapes through vent hole 20. Notably, valve 13 remains open during the self-priming process, because the pressure in tank 11 is little more than atmospheric.

Once the pump has been primed, the liquid that arrives at the impeller eye through the suction pipe fills tank 11, eventually generating pressure sufficient to close valve 13, thereby closing-off the recirculation circuit. At this points the pump commences normal operation and liquid begins flowing from discharge pipe 10.

Should an air bubble or pocket form during pump operation, it would likely cause valve 30 to close with accompanying pressure drop in the tank, thus re-opening valve 13, 50 that liquid would once again reach the impeller eye through pipe 28. This, in turn, steps up the impeller's suction capacity, thereby re-opening valve 30 and triggering a new self-priming cycle until the pump is fully primed.

When the presence of air in the suction pipe is due to lack of liquid (e.g., in the case of breakage of the suction pipe,) the liquid present in the system continues to circulate, thereby preventing breakage of the seal and serious damage to the pump, etc.

When the pump is shut down, the pressure in tank 11 will drop and thus cause valve 13 to re-open. Therefore the next time the pump is operated, it will be in optimal condition for re-starting the self-priming process.

For example, according to one embodiment, in order to achieve a maximum suction head, the section of recirculation pipe 28 is equal to about half the section of the pump's suction pipe and the flow section of annular passage 29 is calibrated to be smaller generally than the section of the suction pipe. The length of the recirculation pipe selected is approximately 200 mm. The suction mouth of the pump has a diameter of about 2", while the discharge pipe has a diameter of about 1 ¼". The pump motor is rated at about 4 kW and operates at approximately 2800 rpm. Under these conditions and with a suction head of about 9 m, the pump primed itself in about two and a half (2 ½) minutes.

The centrifugal pump, in accordance with the present invention, offers numerous advantages, including:

a) rapid self-priming at pump start-up, even when the pump operates under considerable suction head (up to about 9 m);

b) the self-priming device does not limit the size of the suction pipe used and, therefore, does not negatively effect pump performance when the pump operates at steady state conditions;

c) the self-priming process automatically activates when air bubbles or pockets are present ample to cause the pump to operate in an irregular manner. In such case, the pressure in chamber 11*b* of the tank is not sufficient to overcome the elastic reaction of spring 17, which raises cap 14 and, thereby, reactivates the circulation of liquid through passage 16 and recirculation duct 28;

d) the seals or stuffing boxes of the pump are protected, even when no liquid passes through the suction pipe, because in such case recirculation of liquid through duct 28 is immediately re-activate.

Generally speaking, tank 11 must necessarily be situated at some level higher than that of the pump, even though it need not be arranged immediately above the same. Indeed, the tank could also be positioned a selected distance from the pump and connected to it by recirculation ducts at the suction and discharge side. Overall, it is considered relatively important that the hydraulic circuit associated with the tank not form siphons or zones that cannot be reached by the liquid either during the filling phase or during self-priming, thereby avoiding air pocket formation that could negatively effect the self-priming process.

It is also important that the liquid coming from the pump be discharged at the bottom of the tank, so that—no matter what the operating conditions—the liquid level in the tank will be sufficient to prevent air from reaching the pump interior. Advantageously, the liquid could be discharged into the tank through a right-angle nozzle 31 projecting into the tank. Similarly, recirculation duct 28 must be connected to the bottom of tank 11 and in a position so as to assure that the liquid will be relatively turbulence-free when it arrives. Wall 12, dividing the tank into two chambers, in addition to facilitating separation of air from the liquid, also is advantageous in preventing formation of a turbulent flow.

The size of the recirculation duct cross-section is about 50% of that of the suction pipe and, therefore, assures an abundant flow of liquid from tank to impeller; when the tank is located remotely or separately from the pump, the size of the pipe will have to be increased appropriately.

The annular passage which is defined by truncated cone portion 22*a* and the free end of pipe stub 26 serves to optimize the pressure drop necessary for the self-priming process as a function of the required suction head, and to improve the hydrodynamic distribution of flow toward the impeller.

The self-priming device, which is comprised substantially of body 21 and, if present, pipe stub 26 inside it, together with recirculation duct 28 and tank 11, may be integrated in the pump body or, otherwise, intimately connected therewith. Alternatively or concurrently, the self-priming device described hereinabove could be utilized for the specific purpose of integrating the self-priming feature into an existing centrifugal pump. As those skilled in the art will appreciate, it may be necessary to resize components of the device, according to such arrangement, so as to be compatible with the pump into which they are to be integrated.

Various modifications and alterations to the invention may be appreciated based on a review of this disclosure. These changes and additions are intended to be within the scope and spirit of the invention as defined by the following claims.

What is claimed is:

1. A centrifugal pump comprising a pump body housing an impeller keyed onto a motor shaft, and provided with a suction mouth and a discharge mouth for communicating with, respectively, a suction pipe and a discharge pipe, wherein a chamber is provided between the suction mouth and the suction pipe, the chamber communicating with a tank situated at a generally higher level than the pump, the tank being interposed between the discharge mouth and the discharge pipe, being in communication with both the discharge mouth and the discharge pipe, and in also communication with the chamber through a recirculation duct having a section generally smaller than that of the suction pipe, between the tank and the chamber, a valve further being provided for cutting off a flow of fluid controlled by pressure existing in the tank and for automatically causing the fluid to be recirculated through the chamber and into the pump when the pressure in the tank drops below a predetermined value wherein a body is interposed between the suction mouth and the suction pipe, the body delimiting the chamber and being provided with an inlet port and an outlet port in coaxial positions, the diameter of the inlet port being generally equal to the diameter of the suction pipe, the body being further provided with a recirculation port connected to the recirculation duct that communicates with the tank, and wherein a pipe stub having an internal diameter generally equal to the diameter of the suction pine extends coaxially from the inlet port into the chamber and toward the outlet port, the chamber having a portion that converges toward the outlet port, such that the free end of the pipe stub defines an annular passage with the converging portion of the chamber.

2. The pump set forth in claim 1, wherein the flow section of the annular passage is adjustable.

3. The pump set forth in claim 2, wherein the body is made up of a plurality of coupled parts and the pipe stub comprises a flange engageable between the parts, annular shims being interposed between one of the parts and the flange that are displaceable between the other of the parts and the flange for adjusting the flow section of the annular passage.

4. The pump set forth in claim 1, wherein the tank comprises an internal wall for dividing it into first and second chambers such that the first chamber communicates with the discharge mouth and the discharge duct, and the second chamber communicates with the recirculation duct, the first and second chambers communicating with each other through an opening formed in the wall where it meets a bottom portion of the tank, the valve for cutting off the flow being interposed between the second chamber and the recirculation duct.

5. A centrifugal pump comprising a pump body housing an impeller keyed onto a motor shaft, and provided with a suction mouth and a discharge mouth for communicating with, respectively, a suction pipe and a discharge pipe, wherein a chamber is provided between the suction mouth and the suction pipe, the chamber communicating with a tank situated at a generally higher level than the pump, the tank being interposed between the discharge mouth and the discharge pipe, being in communication with both the discharge mouth and the discharge pipe, and in also communication with the chamber through a recirculation duct having a section generally smaller than that of the suction pipe, between the tank and the chamber, a valve further being provided for cutting off a flow of fluid controlled by pressure existing in the tank and for automatically causing the fluid to be recirculated through the chamber and into the pump when the pressure in the tank drops below a predetermined value, wherein the tank comprises an internal wall for dividing it into first and second chambers such that the first chamber communicates with the discharge mouth and the discharge duct, and the second chamber communicates with the recirculation duct, the first and second chambers communicating with each other through an opening formed in the wall where it meets a bottom portion of the tank, the valve for cutting off the flow being interposed between the second chamber and the recirculation duct, and wherein the valve for cutting off the flow comprises a passage formed in a bottom portion of the second chamber and a cap that is elastically maintained in a position away from the passage whenever the pressure in the second chamber is generally below a predetermined value.

6. The pump set forth in claim 5, wherein the wall is further provided with an opening near a top portion of the tank between the first chamber and the second chamber.

7. The pump set forth in claim 1, wherein the section of the recirculation duct is about half the section of the suction duct.

8. The pump set forth in claim 1, wherein the flow section of the annular passage is generally smaller than the section of the recirculation duct.

9. A centrifugal pump comprising a pump body housing an impeller keyed onto a motor shaft, and provided with a suction mouth and a discharge mouth for communicating with, respectively, a suction pipe and a discharge pipe, wherein a chamber is provided between the suction mouth and the suction pipe, the chamber communicating with a tank situated at a generally higher level than the pump, the tank being interposed between the discharge mouth and the discharge pipe, being in communication with both the discharge mouth and the discharge pipe, and in also communication with the chamber through a recirculation duct having a section generally smaller than that of the suction pipe, between the tank and the chamber, a valve further being provided for cutting off a flow of fluid controlled by pressure existing in the tank and for automatically causing the fluid to be recirculated through the chamber and into the pump when the pressure in the tank drops below a predetermined value, wherein the fluid is discharged into the tank through a nozzle in the form of a right-angle bend that extends from a bottom portion of the tank into the first chamber.

10. A device for self-priming a centrifugal pump, the device comprising a body interposed between a suction pipe and a suction mouth of the pump, the body delimiting an internal chamber for communicating with the suction pipe by a first inlet port and with the suction mouth by an outlet port, and further being provided with a second inlet port for communicating, through a recirculation duct, with a tank arranged at a level generally higher than the level of the pump and communicating with both a discharge mouth of the pump and a discharge pipe, the recirculation duct having a section generally smaller than the section of the suction pipe and comprising a valve for cutting off a fluid flow controlled by the pressure existing in the tank, such that recirculation of the fluid through the chamber and into the pump will start automatically whenever the pressure in the tank drops below a predetermined value, wherein the chamber has a portion converging toward the outlet port and, coaxially to the first inlet port, a pipe stub of a diameter generally equal to that of the suction pipe extending within the chamber, the free end of the pipe stub forming an annular passage with the converging portion.

11. The device set forth in claim 10, wherein the flow section of the annular passage is adjustable.

12. The device set forth in claim 11, wherein the body comprises a plurality of coupled parts and the pipe stub includes a flange engageable between the parts, annular shims being interposed between one of the parts and the flange that are displaceable between the other of the parts and the flange for adjusting the flow section of the annular passage.

13. The device set forth in claim 10, wherein the tank comprises an internal wall for dividing it into first and second chambers such that the first chamber communicates with the discharge mouth and the discharge duct and the second chamber communicates with the recirculation duct, the first and second chambers communicating with each other through an opening formed in the wall where it meets a bottom portion of the tank, the valve for cutting off the flow being interposed between the second chamber and the recirculation duct.

14. A device for self-priming a centrifugal pump, the device comprising a body interposed between a suction pipe and a suction mouth of the pump, the body delimiting an internal chamber for communicating with the suction pipe by a first inlet port and with the suction mouth by an outlet port, and further being provided with a second inlet port for communicating, through a recirculation duct, with a tank arranged at a level generally higher than the level of the pump and communicating with both a discharge mouth of the pump and a discharge pipe, the recirculation duct having a section generally smaller than the section of the suction pipe and comprising a valve for cutting off a fluid flow controlled by the pressure existing in the tank, such that recirculation of the fluid through the chamber and into the pump will start automatically whenever the pressure in the tank drops below a predetermined value, wherein the tank comprises an internal wall for dividing it into first and second chambers such that the first chamber communicates with the discharge mouth and the discharge duct and the second chamber communicates with the recirculation duct, the first and second chambers communicating with each other through an opening formed in the wall where it meets a bottom portion of the tank, the valve for cutting off the flow being interposed between the second chamber and the recirculation duct, and wherein the valve comprises a passage formed in a bottom portion of the second chamber and a cap that is elastically maintained in a position away from the passage whenever the pressure in the second chamber is generally below a predetermined value.

15. The device set forth in claim 14, wherein the wall is also formed with an opening near a top portion of the tank through which the first chamber communicates with the second chamber.

16. The device set forth in claim 10, wherein the flow section of the recirculation duct is about half the flow section of the suction pipe.

17. The device set forth in claim 10, wherein the flow section of the annular passage is generally smaller than the section of the recirculation duct.

18. The device set forth in claim 10, wherein the fluid is discharged into the tank through a nozzle in the form of a right-angle bend extending from a bottom portion of the tank into the first chamber.

* * * * *